US005390011A

United States Patent [19]

Theodoulou

[11] Patent Number: 5,390,011

[45] Date of Patent: Feb. 14, 1995

[54] COMPACT IMAGING ROLL PRINTER

[75] Inventor: Sotos M. Theodoulou, Bramalea, Canada

[73] Assignee: Delphax Systems, Canton, Mass.

[21] Appl. No.: 68,237

[22] Filed: May 27, 1993

[51] Int. Cl.[6] ..... G03G 15/14

[52] U.S. Cl. ..... 355/272

[58] Field of Search ..... 355/211, 212, 271, 277, 355/279, 274; 219/216; 346/153.1, 155, 159, 160

[56] References Cited

U.S. PATENT DOCUMENTS

| | | | |
|---|---|---|---|
| 3,868,181 | 2/1975 | Tanaka et al. | 355/212 X |
| 4,105,320 | 8/1978 | Bean | 355/274 |
| 4,160,257 | 7/1979 | Carrish | 346/159 |
| 4,572,655 | 2/1986 | Morrison et al. | 355/298 |
| 4,628,183 | 12/1986 | Satomura | 219/216 |
| 4,679,060 | 7/1987 | McCallum et al. | 346/159 |
| 4,724,303 | 2/1988 | Martin et al. | 219/216 |
| 4,883,941 | 11/1989 | Martin et al. | 219/216 |
| 4,984,025 | 1/1991 | Landa et al. | 355/271 X |
| 4,990,942 | 2/1991 | Therrien et al. | 346/155 |
| 4,992,807 | 2/1991 | Thomson | 346/155 |
| 5,012,291 | 4/1991 | Buchan et al. | 355/271 |
| 5,103,263 | 4/1992 | Moore et al. | 355/212 |
| 5,115,279 | 5/1992 | Nishikawa et al. | 219/216 X |
| 5,155,506 | 10/1992 | Yamaguchi | 346/160 X |
| 5,216,466 | 6/1993 | Mitani | 355/271 X |

*Primary Examiner*—Fred L. Braun

*Attorney, Agent, or Firm*—Lahive & Cockfield

[57] ABSTRACT

A compact printer includes a print roll on which a latent image is deposited, toned, then heated and transferred in a "transfuse" step. A commutating heater selectively heats a surface sector of the rotating roll for transfusing the image and roll cleaning, and the roll body remains below a toner agglomeration temperature. The roll has a rigid core and a surface structure that includes a plurality of heater lines and a hardcoated elastomeric imaging layer covering the heater lines. The imaging layer includes a conductive sublayer and a dielectric surface layer, both having greater thermal conductivity than an outer region of the core so that heat from the heaters preferentially flows to the deposited toner image. The printer scrolls portions of a latent image, which is toned, heated and transferred onto a separate recording member to form a final image having, in general, a much greater surface area than the roll. Preferably a blower cools the core, establishing a thermal equilibrium well below a toner melt temperature. A stepper motor engages the core to rotate it, and position signals from the stepper drive coordinate deposition of the latent image and feeding of the recording sheet. The roll, which may be under two inches in diameter, undergoes repetitive thermal cycling, with fusing heat traveling preferentially to the surface in a limited sector, and residual heat traveling to the core after the toner is removed.

19 Claims, 4 Drawing Sheets

COMPACT IMAGING ROLL PRINTER

BACKGROUND

This invention relates to compact primers of the type used, for example, with personal computers, wherein the computer produces a stream of binary electrical signals to control the printer to print typed and graphic output. In particular it relates to a compact, portable printer of this class—that is, a signal-activated printer of this general size and print capacity—having a relatively simple mechanical structure and high performance.

Presently, the design of primers of this type is very much influenced by economics, with the result that there have evolved a small number—illustratively two, although there is room for argument—of general classes of such devices. One of these classes consists of machines that sell for about one to five thousand dollars. This class includes machines such as laser printers, that form a dielectric latent image on a photoconductive drum, tone the latent image and transfer the toned image to paper, on which the image is subsequently fused. This class of printer borrows various ones of its image-forming steps or mechanisms from the field of photocopiers or electrographic printers, and thus tends to involve many parts that wear, require adjustment and add cost both to the initial price and to required maintenance of the machine. However, the basic technology is quite mature, and the basic consumable toner component is cheap. These printers are capable of relatively high speed and high quality imaging.

The second general class consists of rather simpler devices, such as ink jet or bubble jet primers, which cost well under one thousand dollars and employ a printhead to directly form the image on a sheet as it is fed through the device. Such devices can be made quite small since they require neither hot fusing stations nor lengthy optical paths, and they can be made quite simple since only a single mechanical coordinating coupling is required, namely that between the sheet advance roller and the print head cross-scan carriage. Moreover, this latter mechanism can be eliminated by using a full page width ink jet head. Other devices of equally simple construction are also available, such as thermal or impact printers, but these tend to require expensive disposables, such as special thermal paper or inked ribbons, and they may produce a decidedly inferior image. However, although simple and initially cheap, ink and bubble jet printers of this second class each have their own limitations in terms of lifetime, failure rates, cost of disposables or, most commonly, printing speed or capacity.

It would therefore be highly advantageous if a printer design could achieve the size and simplicity of this latter class of instruments while employing the well developed and high quality imaging processes of the first class mentioned above. In particular, a simple printer employing toner imaging processes would offer great advantages.

SUMMARY OF THE INVENTION

This is achieved in accordance with a basic embodiment of the present invention by providing a printer roll with a rigid core having longitudinally extending heater elements on the outside activated by commutation as the roll tums. A hardcoated elastomeric surface covers the roll and heater, and receives an electric charge latent image, which is toned and then heated to melt the toner before the melted toner is directly transferred (or "transfused") to a recording sheet at a relatively low pressure. The rigid core has low thermal conductivity compared to the surface layer, and the heater elements are only activated over a partial circumference of the roll immediately following the toning station, up to and including the region of contact with the recording sheet. Preferably the core is cooled by cooling air circulating therethrough, so that the core and surface layer both remain at a low temperature, except at the portion of the roll perimeter leading up to the transfuse nip. The total circumference of the roll is less the length of a printed page, so that at any given time only partial latent and toned images exist, which scroll through a page, an entire page image existing only in final form after a continuously formed series of image segments has been transferred to the recording sheet.

Because the core is formed of material of lower thermal conductivity then the surface layer, heat from the heaters travels primarily to the toner held on the roll surface. Further, the thermal mass of the roll may be much greater than that of the surface layer, so that while the surface is heated above about 120° C. at the transfuse region, the roll as a whole remains at a temperature below about 60° C. and the efficiency of temperature dependent processes of latent image formation and toning is not impaired.

The roll is advanced by a stepper motor, the positioning signals of which also serve for synchronizing operation of the printer.

BRIEF DESCRIPTION OF THE DRAWINGS

These and other features of the invention will be understood from the following description, taken together with the drawings, wherein.

DETAILED DESCRIPTION

Figure 1:
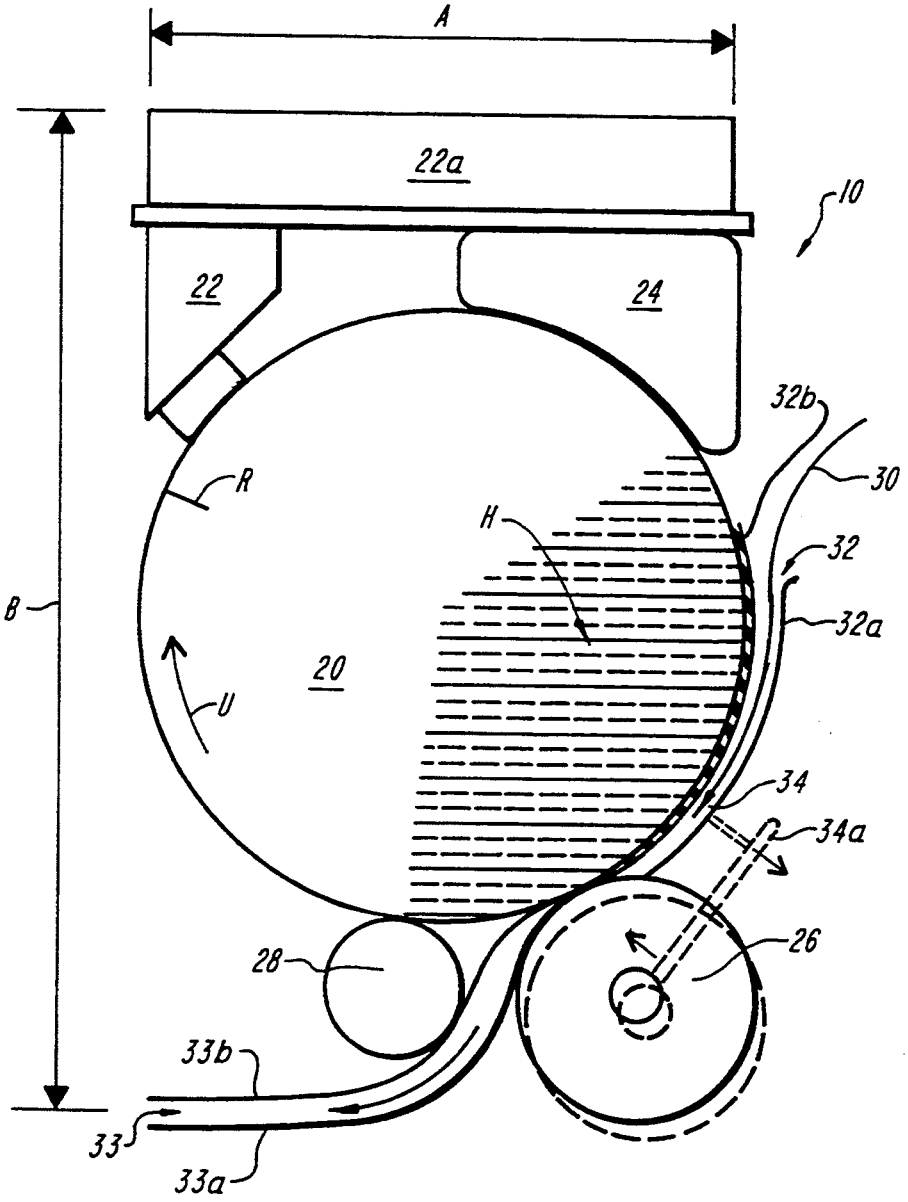
FIG. 1 is a schematic cross-sectional view of a roll printer according to the present invention.

As shown in cross-section in FIG. 1, a compact printer 10 in accordance with the present invention includes an imaging roll 20 of cylindrical shape, and a number of image-processing elements 22, 24, 26 disposed about the outside of the roll for forming and transferring an image to a recording sheet 30 as it is fed between elements 20 and 26. Roll 20 rotates in the direction indicated by arrow C, so that a point on the surface successively passes the stations 22, 24, 26 in clockwise order. Each of these elements shown in cross section will be understood to extend, in a direction perpendicular to the plane of the drawing, for the full width of a sheet 30. Thus, for a given angular position (indicated by "R" in the drawing for reference purposes) there is an entire linear region extending across the surface of the roll which successively passes by the aforesaid imaging elements as the roll rotates.

A housing (not shown) surrounds the device and provides end plates and walls for supporting the various elements in alignment and enclosing the mechanical elements.

As shown, the roll 20 has a diameter "d", and the device as a whole is configured such that its essential elements occupy a box of approximately rectangular cross-section, with a width A not appreciably greater than d, and a height B only slightly larger to accommodate the paper path and the imaging elements spaced about the roller. By way of scale, d is relatively small, as little as about three and one-half to four centimeters, while the dimension B may be only several centimeters greater in a representative printer which prints normal twenty by thirty centimeter or longer page-size images.

A partial rotational sector H of roll 20 is indicated by shading in the FIGURE, extending from just past image forming element 24 to somewhat past the roller 26. This sector is a hot sector, which, in accordance with a principal aspect of the invention discussed below, is implemented with a heater structure that heats the developed image for transfer to sheet 30 while not substantially perturbing the temperature of the roll as a whole.

Operation of the device will be discussed in detail with reference to a particular embodiment wherein a latent image is laid down on roll 20 by a ionographic, charge transfer or electron beam imaging print cartridge 22 and the latent image is developed as it contacts or rotates in proximity to a toner-applying brush assembly or toner applicator 24.

Print cartridge 22 is of the type illustrated in U.S. Pat. Nos. 4,155,093, 4,160,257, 4,679,060, 5,166,709 and elsewhere, and consists of a multi-layer set of electrodes that cross at a matrix array of points and are actuated to generate an imagewise set of glow discharge points in enclosed cavities from which charge carriers are gated as projected charged particle beams onto the imaging member. By way of example, a relatively small cartridge having 300 dots per inch (dpi) resolution may be implemented having four RF drive electrodes extending parallel to the axis of roll 20 and crossed by finger electrodes, the finger electrodes being arranged in sixteen segments with thirty-two finger electrodes per segment. Such a cartridge would have a thickness, in the direction of the roll arc perimeter, of under about two millimeters. Reference is made to the above-referenced U.S. patents, which are incorporated herein by reference for purposes of providing details of fabrication and operation of such cartridges. Cartridges of this type may, in addition, be commercially obtained from the present applicant, Delphax Systems, of 5030 Timberlea Boulevard, Mississauga, Ontario, Canada.

Print cartridge 22 need not be curved or have special focusing fields, since a simple planar cartridge will have substantially uniform beam characteristics over the relatively narrow width described above. The cartridge is actuated by a control card **22*a*, also conventional, which, by way of example may change the bias level of selected finger electrodes in accordance with a block or line of rasterized screen data so that as the roll rotates, charged particles are deposited thereon in a desired pattern to form a latent image. The control electronics, card 22*a***, may also control other modules and functions, such as an erase rod and paper transport, which are discussed further below.

The developing station 24 includes a dry powder toner reservoir, and a rotating brush, vibrating comb or other applicator mechanism for dusting the surface of the roll 20 with toner powder from the reservoir so that it adheres in charged areas and the latent image is toned. Appropriate seals or other powder containment mechanisms prevent scattering of toner from the reservoir 24 which may operate with any of a number of toners known in the art, although preferably it applies a relatively low melting point toner formulation, e.g., a resin or wax-based toner that softens at about 100° C. or even lower.

Following toning of the imaging roll, a heater is activated so that, as the roll continues to carry the toned image through the sector H, the. applied toner melts on its surface. A recording sheet—for example, a sheet of filled or of bond paper, clear acetate, or other recording medium—is held by a retaining catch 34 aligned in an inlet feed slot 32 formed by opposed guide sheets **32*a*, 32*b*. The recording sheet, upon release of catch 34, down into the nip between the imaging roll 20 and a pressure roll 26. Pressure roll 26 presses it against the melted toned image so that the tacky heated toner sticks to the sheet and it "wicks" up the pattern of melted toner thereof, thereby transferring and fusing the toned image onto the sheet 30 in a single step. As illustrated schematically, roll 26 is preferably mounted with a movable central axis, so that the pressure roll 26 can be disengaged from the imaging roll. Preferably, a mechanism such as rocking bar 34*a* couples the paper release catch 34 and the pressure roll support plates, so that a single actuating mechanism may simultaneously release the sheet 30, and shift the roll 26** into a nip-forming position of engagement.

Detailed properties of the imaging surface and the roll rotation will be discussed below, in relation to FIGS. 2A–2C. Here however, it is enough to note that after passing through the nip, the leading edge of sheet 30 is diverted into a guide channel 33, while the imaging surface of the roll 20 continues to rotate past a fourth station at which a cleaning roll 28 removes any still-melted toner remaining on the roll. Roll 28 may be a brush roller, an incrementally advanced web of non-woven textile, or other cleaner of the type conventionally used to clean or condition fusing rolls or webs. Beyond the cleaning station, the imaging surface is not heated, and its surface temperature drops to an equilibrium temperature which is well below the temperature at which contact with reservoir 24 would cause toner agglomeration, or at which the charging abilities of the surface would be affected.

As noted above, the system of the present invention is intended as an inexpensive and mechanically simplified printer with very high image quality for portable use with a microcomputer. As described so far, there are no separate image transfer belts, or mechanical optical scanning elements, and a single image roller 20 accommodates all functions of charge imaging, toning, fusing, and final transfer. Concommitant with these multiple capabilities, the imaging roll has a relatively complex structure, which is illustrated in greater detail in FIGS. 2A–2C.

Roll 20 is a cylindrical roll having a length greater than the printable page width, generally twenty centimeters and, as noted above, a small diameter preferably under about two inches. As shown in section in FIG. 2A, roll 20 includes a core 121 that provides a rigid structural support across the full page width, and an imaging surface layer 122 around the periphery of the core. Core 121 has a hollow interior 125 with a regular series of splines or teeth 123, 124 formed in the core body 121 for driving the roll. The core may be rotatably mounted on a central spindle, and the elements 123, 124 be located only at one end, to be driven by a stepper motor through an appropriate linkage, or the core may be driven by a splined shaft that is itself driven. In any case, core 121 is formed of stiff material so that deflection over the line width does not impair image transferability at the nip with pressure roll 26.

The surface layer 122 is thinner than core 121, and unlike the core it does not contribute to the structural strength of the roller. Further, surface layer 122 is formed of a thin relatively heat conductive material, while the core 121 is formed of a material, such as a plastic, a foamed epoxy or a sintered glass bubble material, that has relatively poor thermal conductivity. Located between the core 121 and the outer surface of layer 122 are a plurality of heater elements 130 which are shown in FIG. 2B. Each heater element 130 is a wire or heater strip which extends along the surface of core 121 parallel to the roll axis. Elements 130 may be deposited for example, by spattering a conductive metal onto the surface of the core to produce a regular set of well-attached thin lines of metal. The elements preferably have relatively small thickness, their purpose being to serve as resistive heating elements, but they are flat and wide, having gaps between successive lines that are preferably smaller than the thickness of the outer imaging layer 122 (FIG. 2A) so that when energized they heat the layer above them uniformly. In the assembled printer, heater elements 130 are actuated by applying electric power thereto as they rotate into the region H between the developer 24 and the cleaner roll 28. This is done by contacting ends of the elements 130 with a curved metal or other conductive plate or a carbon brush, either on the end-face or the peripheral surface of the roll 20 at one end thereof. The other end of each element 130 may be permanently connected to a common electrode, ground or conductive shield. If voltage drop across the length of the element is found to be too great, connection may be made to both ends, and a central metallic grounding band may be provided, accessed from within the roller, so that the heater current path is shorter. Thus, the invention contemplates different layouts and connections for an array of transverse heater elements which are actuable in sectors to heat the toner on the roll surface.

Figure 2A:
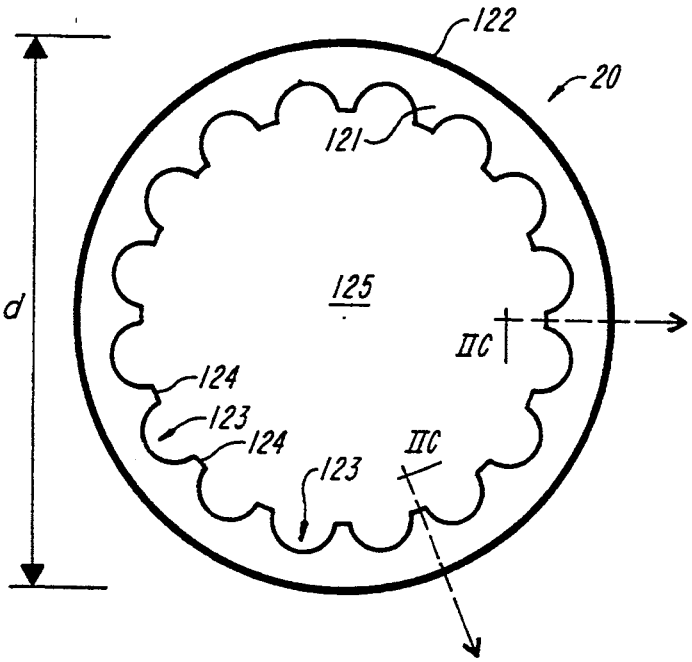
FIGS. 2A–2C show details of roll construction for the roller of the roll printer of FIG. 1.
Figure 2B:
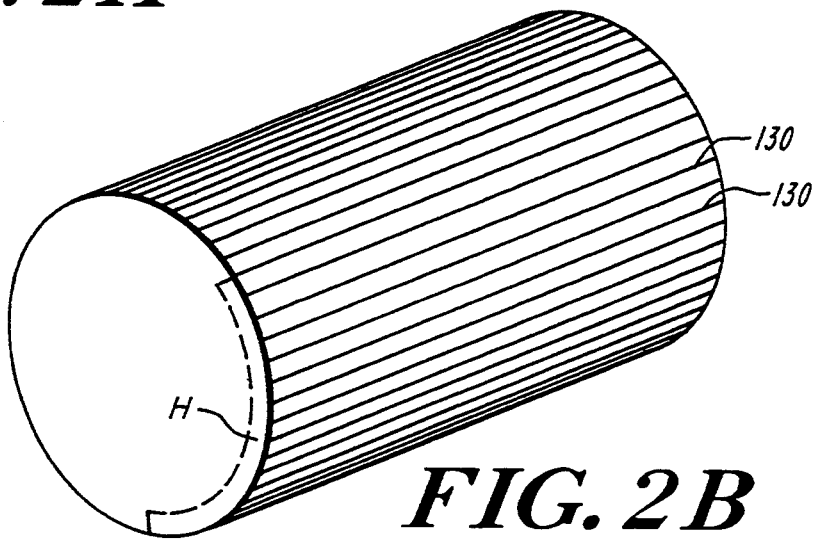
Figure 2C:
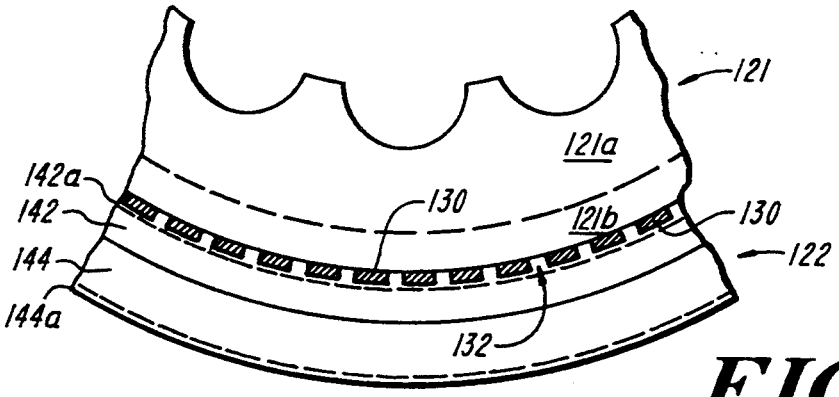

FIG. 2C is a much enlarged section along the position indicated in FIG. 2A of the core 121 and surface layer 122. As shown, heater elements 130 are uniformly and closely spaced so as to substantially cover the entire roll periphery. Gaps 132 are provided between adjacent elements 130 so that the heater lines may be separately actuated.

The surface layer 122 consists of two principal layers, labelled 142, 144 each of which is preferably formed of a elastomeric material having a hardness in the range of 20–50 shore A, the layer 142 preferably being an electrically conductive material, such as a conductive silicone rubber, which in operation is impressed with a voltage selected to establish a backplane potential for transport of charge carriers from the print cartridge 22 when it lays down the latent image, while layer 144 is a dielectric material for holding the charge so deposited. A thin surface layer **144*a* covers layer 144, and provides a hard coat (illustratively, a coating of 35 Shore D durometer or greater hardness) that prevents the roll from being "tacky", so that toner particles cannot become embedded in it, while layer 144*a* is still so thin as to not rigidify the surface. In effect, hard coat 144*a* is kept thin enough to allow the surface to deform in conformity with the surface roughness of a typical plain paper recording sheet. For example, using a methoxy-functional silicone resin such as Dow R-4-3117, a hard surface coating 144*a* having a thickness around 0.0025–0.005 mm appears satisfactory. Hard coat 144*a* may also be formed on the surface of elastomeric dielectric layer 144** by processes other than coating. For example, the surface may be selectively cross-linked to a shallow depth by ion beam, UV or electron beam bombardment, or by RF plasma treatment.

In general it is preferable that the heater elements 130 directly contact conductive layer 142, and in fact serve to establish the potential of that layer, while the relatively higher resistance of layer 142 effectively smooths the field discontinuities at the edges of the separate heater lines.

The reader is referred to commonly-owned issued U.S. Pat. Nos. 5,103,263 of Moore et al, and 5,012,291 of Buchan et al for a full description of a dimensionally-stable hard coated elastomeric imaging belt system and of techniques for varying the dielectric, mechanical or electrical properties of an elastomeric layer to obtain suitable charging, toning and melt-transfer properties of the belt as indicated above. The disclosures of these two patents are hereby incorporated herein by reference in order to provide a full understanding of the theory and practical implementation of a hard-coat elastomeric imaging system. A significant distinction of the present invention over the systems of those patents, however, is the presence of a commutating layer of heater elements 130 below the imaging surface, and also the presence of the stiff core 121, rather than a tensioned belt, to provide dimensional stability, and also in some embodiments, to form an enhanced thermal environment for thermal cycling.

The materials of the imaging surface and the core are selected, in relation to the heaters, to preferentially drive heat from the temporarily actuated heater to the toned surface. It will be appreciated that the core, if implemented with a plastic of low thermal conductivity, may have some bending deflection near its center that necessitates making the elastomeric layer slightly thicker than the thickness indicated for a belt in the aforesaid patents. However, it is equally possible to implement the core with a very stiff (e.g., cast aluminum) roller center which undergoes negligible bending deflection, and to place a thermally and electrically insulating shell **121*b* over the non-deflecting aluminum center 121*a* (FIG. 2C) to support the heater lines 130 and imaging surface. In that case, the required dimensions and properties for the elastomeric and hard coat layers correspond closely to those of the belt described in the aforesaid patents. In either event, the invention further contemplates loading layer 144** with a powder of high-dielectric material, to the extent appropriate for adjusting its charging characteristics for the given print cartridge and toner system, so as to achieve the correct levels of surface charge simultaneously with the desired degree of surface conformability.

It should be noted that an important aspect of the present invention is the selective actuation of heater elements to drive heat to the surface and thermally cycle the roll surface about its perimeter such that a fusing temperature is attained only in the transfuse nip and cleaning regions. In the two-layer embodiment of the core 121 illustrated in FIG. 2C, the thermal cycling is enhanced by providing a central core **121*a* of high thermal capacity, such as aluminum, and a supporting shell 121*b* of relatively low thermal conductivity. Shell 121*b* then attains a somewhat higher equilibrium temperature, about which the surface temperature thermally cycles, while the core center 121*a*** provides a large thermal reservoir to pull down the temperature outside the hot segment. As in the other embodiments, a circulating fan preferably cools the core.

It is further understood that other necessary elements of the print system, although not specifically illustrated, are contemplated to be included in a complete printer 10 in accordance with this invention. For example, an erase rod for discharging roll 20 to a uniform level, may be placed between cleaner 28 and print cartridge 22. This erase rod can be a corona rod, or a conductive brush or roller that contacts the surface of the roll 22. Similarly bias adjustments for controlling print contrast, actuator buttons for advancing the sheet without printing, paper edge sensors to retract roller 26 or initiate various transport or development steps and other such features may be included in the printer, and preferably operated by circuits within the control card 22*a*.

Figure 3:
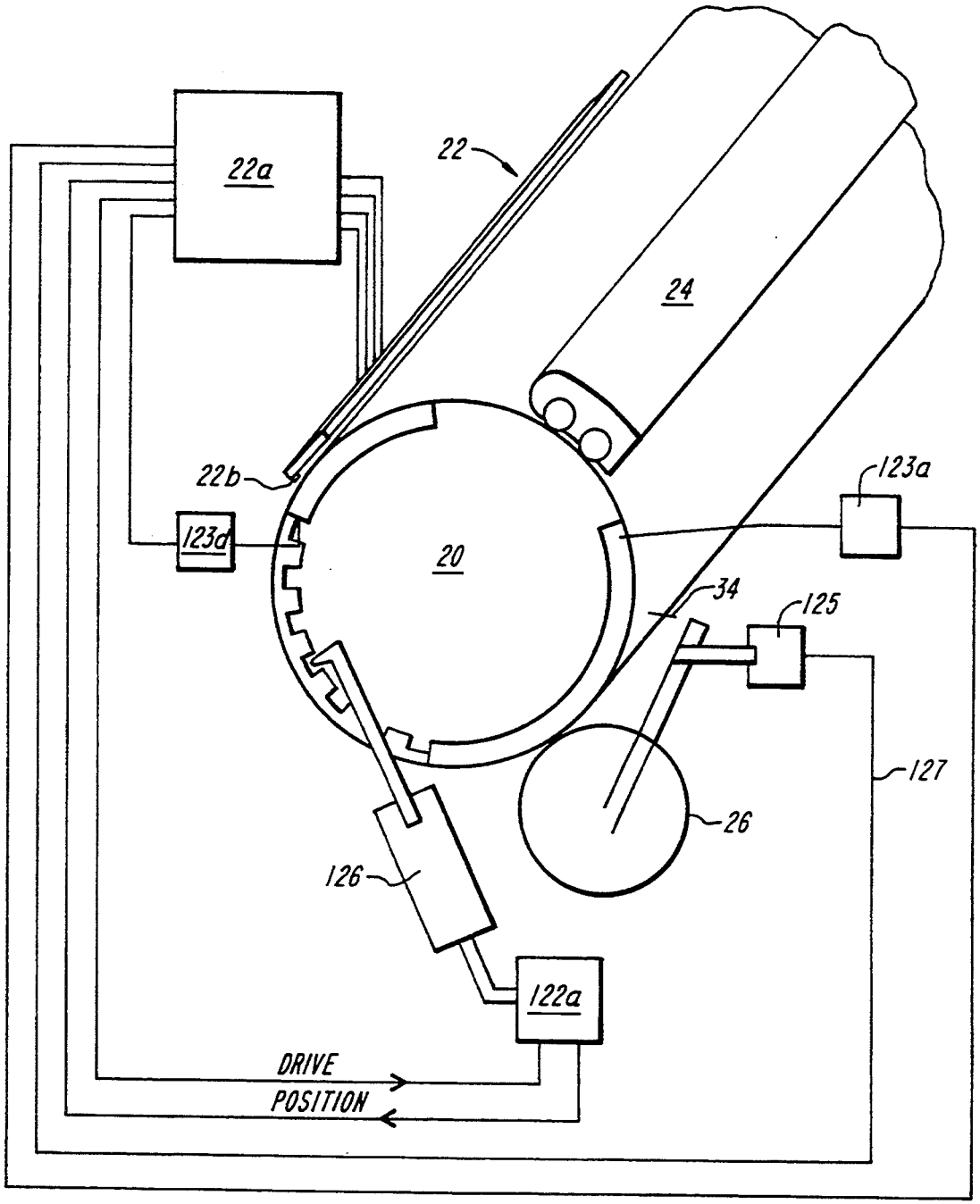
FIG. 3 shows a schematic diagram of system operation for the roll primer of FIGS. 1–2C.

FIG. 3 illustrates a preferred form of the erase rod, 22*b*, which is implemented as a thin conductive line coated with a dielectric polymer, spaced from the active area of the print cartridge 22 and extending across the leading edge thereof. Rod 22*b* is actuated with an rf signal of 100–150 KHz at about 2 KV peak-to-peak, and is formed on the same board or substrate as the imaging electrodes of cartridge 22.

A blower or fan is preferably located within the printer housing to blow cooling air through the core to assure that even in very hot weather, the non-heated segments attain steady state temperatures well below the toner clumping threshold, and close to the ambient temperature.

FIG. 3 schematically illustrates the elements of a printer system 100 including a charge transfer cartridge 22, imaging roll 20, toner assembly 24, pressure roll 26 and cleaning roll 28 as previously described. The print cartridge drive circuit 22*a* is illustrated as having a number of simple switching or control elements responsive to the roll position and print data for controlling elements of the printer.

Specifically, the cartridge drive controls a stepper drive unit 122*a* that drives stepper 126 to rotate the roll 20. Unit 122*a* also sends back position signals, for controlling heater switch 123*a* connected to a commutating heater brush 123*b* which is turned ON once the first deposited image area has reached the region denoted "H" in FIG. 1. A second commutating brush 123*c* and switch 123*d* are energized to set the potential of the conductive backplane (142, FIG. 2C) in at least the area below the print cartridge. This brush may contact all heater lines 130. A third control switch energizes line 127 to retract a solenoid 125 that disengages the paper detent 34 and engages pressure roll 26, so that paper held in the inlet slot drops down to receive an image. It will be understood that unlike the heater, which is preferably switched ON only after an image has been deposited, the detent 34 is released in phased relation to the Start of Page signal of cartridge 22*a*, to assure proper header spacing.

Rather than self-feeding when released through a substantially vertical slot as indicated, the recording sheet may reside at a holding station and be actively transported by position-controlled transport rollers or belts. In that case, transport is coordinated using a number of sensors to detect the sheet presence or position, and to coordinate the actuation of the transport with the presence of the toned image at the transfuse nip.

The foregoing printer is intended especially as a compact but relatively low speed device, in which a small dram is made to thermally cycle in an efficient manner between a fusing and a toning temperature as it rotates. In various other embodiments, the cartridge drive may be equipped with a block white space detector that inspects the coded cartridge drive signals to detect when no image has been deposited for a number of consecutive lines, and that tums the heater OFF as a non-imaging part of the roll passes the hot zone. This feature is deemed especially useful for a battery-powered embodiment, in order to conserve power as well as lower the heat loading of the device. The erase rod 22*b*, may alternately be implemented as a conductive roller contacting the roll surface (not shown).

It is further contemplated that a printer in accordance with the present invention may be built more economically, although with a sacrifice in possible speed, by providing separately actuable sections of the print cartridge, and providing switching assemblies to successively connect the driver circuitry to each section of the print cartridge. Such a step can provide great savings in circuit costs.

It will be appreciated that the foregoing printer eliminates many costly elements, such as drive, transport, alignment or synchronizing structures, that contribute to the high cost of prior art toner-based printers. Many of the same advantages are obtained in another embodiment wherein a small rigid roller and a surrounding imaging belt carry out the functions of roll 20 of the first described embodiment.

Figure 4:
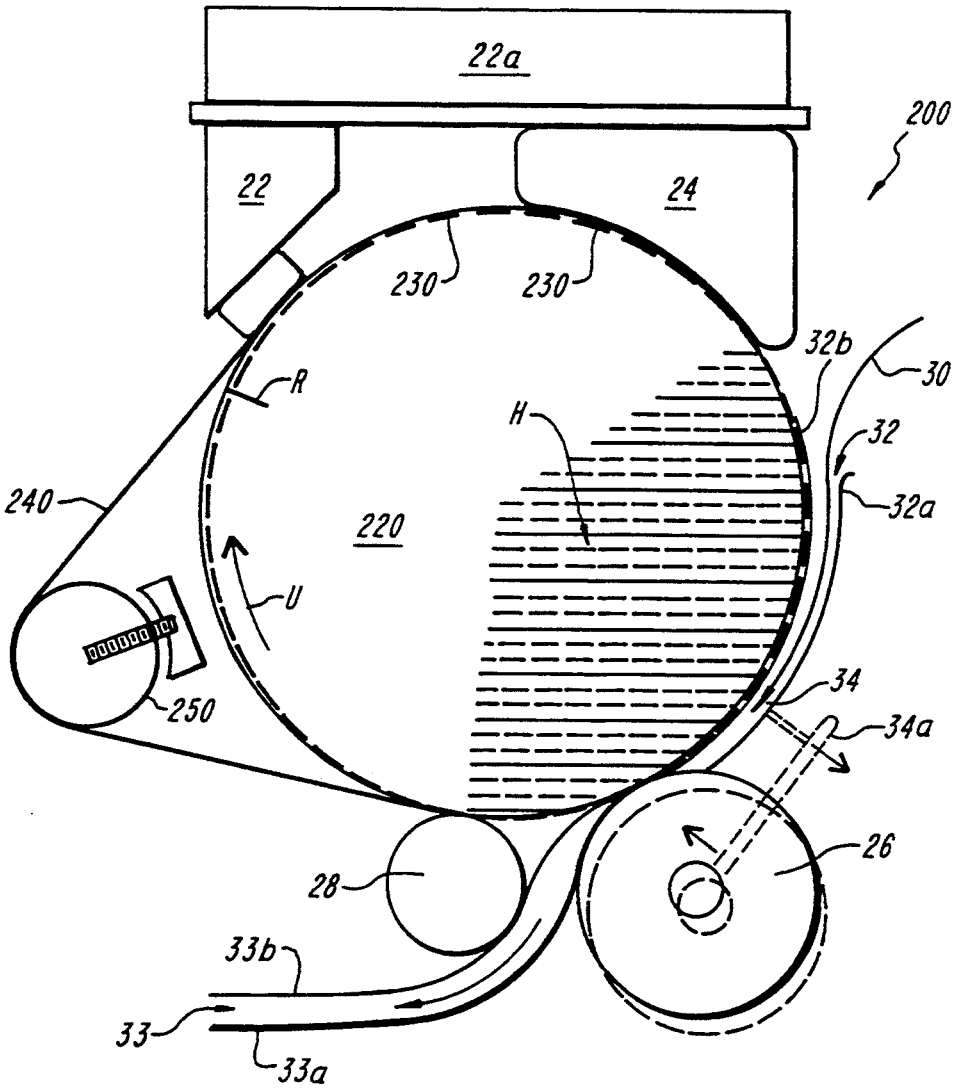
FIG. 4 shows an alternative embodiment.

Such a device 200 is shown in FIG. 4. In the illustrated embodiment, the roll or "drum" 220 is shown as carrying heater lines 230, while the belt 240 is formed with a hardcoated dielectric elastomer, and preferably also the conductive sublayer forming a backplane for imaging, although this sublayer may reside on roll 220. Because the belt is only slightly larger than the drum, no mechanical guide tensioning or alignment mechanisms are required, other than a simple idle roller 250. Moreover, the drum itself provides support and dimensional stability in the region between the cartridge and the transfer station. In a further variation of this embodiment of the invention, the web may be cooled by air flow when it is not contacting the drum, allowing both the drum and web to be separately cooled before the next image cycle commences. Also, although not preferred, the heater lines 230 may be formed on the backside of belt 240, relegating to the drum 220 only the functions of structural support and electrical commutation.

The invention being thus described, other variations and modifications will occur to those skilled in the art, and all such variations and modifications are considered to lie within the scope and spirit of the invention, as set forth in the claims appended hereto.

What is claimed is:

1. An imaging roll for use in a system for producing a print, such imaging roll including a cylinder forming a rigid core of low thermal conductivity, said core including drive engagement means for controllably driving said core a plurality of heating elements extending parallel to the axis of said cylinder and distributed over an outer region of said cylinder, a hardcoated elastomeric layer over said plurality of heating elements, said hardcoated elastomeric layer having a capacitance per unit area effective to hold a developable latent charge image and being non-tacky so as not to accumulate toner particles, said hardcoated elastomeric layer further being non-adherent to melted toner, and said heating elements being separately actuable by commutation as said core is driven so that by commutating said heating elements ON in a linear region bearing a toned image the toned image is melted and transfers to a recording sheet upon contact;

said hardcoated elastomeric layer further having a conductive sublayer forming a backplane to establish a potential for attracting charged particles to form said developable latent charge image so that a latent, toned and melted image may be successively formed on a linear region of said roll and transferred from said roll directly to a recording member as a final image as said roll rotates.

2. An imaging roll according to claim 1, wherein said hardcoated elastomeric layer has thermal conductivity greater than said core so that heat from said heating elements preferentially heats toner deposited on said layer.

3. An imaging roll according to claim 1, wherein said cylinder has a greater thermal mass than said elastomeric layer so as to cool said layer when the heating elements are OFF.

4. An imaging roll according to claim 1, wherein said core includes ventilation means.

5. An imaging roll for use in an electrographic imaging system, such imaging roll comprising a hard-coated elastomeric dielectric surface imaging layer having a conductive backplane for establishing a charge attracting potential of said dielectric surface imaging layer for non-contact deposition of electrically charged particles to constitute a latent charge image thereon, a sub-layer including segmented heater elements extending parallel to an axis of said roll, and a rigid central core, said segmented heater elements having contacts arranged for commutating ON as said central core rotates, and being disposed for preferentially driving heat through said surface imaging layer to heat a toned image on said imaging layer for contact transfer directly to a recording sheet.

6. An imaging roll according to claim 5, wherein the rigid central core includes a thermally insulative shell which carries said segmented heater elements, and a central core body inside said shell, said central core body having a heat mass substantially greater than that of said surface imaging layer and said shell having a thermal conductivity less than that of said dielectric surface layer.

7. An imaging roll according to claim 6, wherein said heat mass is greater than that of said shell, said heater elements and said surface imaging layer combined.

8. A compact printer comprising a roll having an axis and periphery with an imaging surface disposed on its periphery, the imaging surface having an area less than an intended image page and a conductive backplane for establishing a charge-attracting potential on the surface first means including a charge deposition printhead for depositing a latent image on a linear region of said imaging surface extending parallel to the axis as the roll rotates past said first means second means for toning the linear region as the roll rotates to form a toned image on said linear region means for transferring the toned image from said roll in heat-softened form directly to a recording sheet as the roll rotates further and cleaning means for removing untransferred toner from the linear region before it again rotates past the first means, and means for synchronizing operation of said first means with rotation of the roll such that the roll rotates more than once scrolling through a latent and a toned image to form a complete image on the recording sheet.

9. A compact printer according to claim 8, wherein said roll has a diameter under approximately two inches.

10. A compact printer according to claim 8, wherein said roll has a commutating heater including linear heater elements disposed about the roll periphery running parallel to the roll axis, said commutating heater commutating ON in the region of said means for transferring and said means for cleaning.

11. A compact printer according to claim 8, comprising a mechanical switch for synchronizing operation of a heater as said linear region rotates beyond said second means.

12. A compact printer according to claim 11, comprising an electrically-activated switch for coordinating operation of said transfer means with operation of said first means.

13. A compact primer comprising a housing a print roll rotatably mounted in the housing, said print roll having a latent imaging surface at its periphery first means including a charge deposition printhead disposed at said periphery for forming a latent image on said surface, said surface having a backplane formed of conductive material for establishing a charge-attracting field between said first means and said surface second means disposed at said periphery for toning the latent image to form a toned image third means disposed at said periphery for transferring the toned image to a recording sheet passed between said third means and said print roll, and a heater mounted with said roll for selectively commutating ON and preferentially heating said surface in the region of said third means such that the toned image is transferred to the recording sheet in a tacky state, and being OFF over a major portion of said periphery so that said surface is unheated at said first and second means.

14. A compact printer according to claim 13, further comprising means for circulating coolant through said roll for maintaining said surface cool away from the region of said third means.

15. A compact printer according to claim 13, further comprising a roll cleaner at said periphery for removing untransferred toner beyond said third means, and wherein said commutating heater also heats said surface in the region of the roll cleaner.

16. A compact printer according to claim 13, wherein said heater includes conductive linear elements electrically contacting said backplane of conductive material.

17. A compact printer according to claim 13, wherein said surface includes a hardcoated dielectric elastomer having compressibility effective to transfer said toned image to plain paper.

18. A compact printer according to claim 17, further comprising a stepper operatively connected to the print roll, and means in electrical communication with said stepper for coordinating engagement of said third means with operation of said first means.

19. A compact printer according to claim 18, wherein the print roll has a core with a thermal mass substantially greater than that of the latent imaging surface, and further comprising ventilation means for cooling the core.

* * * * *

UNITED STATES PATENT AND TRADEMARK OFFICE

CERTIFICATE OF CORRECTION

PATENT NO. : 5,390,011
DATED : February 14, 1995
INVENTOR(S) : Sotos M. Theodoulou It is certified that error appears in the above-indentified patent and that said Letters Patent is hereby corrected as shown below:

At column 1, line 33, replace "primers", with --printers--.

At column 1, line 66, replace "tums", with --turns--.

At column 2, line 24, after "120°C", delete ".".

At column 2, line 26, after "60°C", delete ".".

At column 2, line 42, replace "primer", with --printer--.

At column 8, line 7, replace "tums", with --turns--

Signed and Sealed this

Sixth Day of February, 1996

*Attest:*

Bruce Lehman

BRUCE LEHMAN

*Attesting Officer*

*Commissioner of Patents and Trademarks*